US009815186B2

(12) United States Patent
Dostinov

(10) Patent No.: US 9,815,186 B2
(45) Date of Patent: Nov. 14, 2017

(54) SHROUD MEMBER FOR A POWERED HAMMER

(71) Applicant: Caterpillar Inc., Peoria, IL (US)

(72) Inventor: Dimitar B. Dostinov, Fort Worth, TX (US)

(73) Assignee: Caterpillar Inc., Peoria, IL (US)

( * ) Notice: Subject to any disclaimer, the term of this patent is extended or adjusted under 35 U.S.C. 154(b) by 437 days.

(21) Appl. No.: 14/510,174

(22) Filed: Oct. 9, 2014

(65) Prior Publication Data

US 2015/0041168 A1 Feb. 12, 2015

(51) Int. Cl.

| | |
|---|---|
| ***B25D 17/24*** | (2006.01) |
| ***B25D 17/20*** | (2006.01) |
| *B25D 17/28* | (2006.01) |
| *E02F 3/96* | (2006.01) |

(52) U.S. Cl.

CPC ..... *B25D 17/20* (2013.01); *B25D 17/24* (2013.01); *B25D 17/28* (2013.01); *B25D 2217/0069* (2013.01); *B25D 2222/03* (2013.01); *B25D 2222/06* (2013.01); *B25D 2250/121* (2013.01); *E02F 3/966* (2013.01)

(58) Field of Classification Search

CPC ..... B25D 17/00; B25D 17/24; B25D 17/11; B25D 17/28; B25F 5/02; E02F 3/966; E02F 5/305

USPC ..... 173/132, 185, 128, 210, 162.2, 90, 115, 173/162.1, 114, DIG. 2; 299/69, 100, 299/104, 105, 64, 67, 37, 37.4, 70; 175/57; 384/276, 295; 29/432, 525

See application file for complete search history.

(56) References Cited

U.S. PATENT DOCUMENTS

| | | | | |
|---|---|---|---|---|
| 4,274,258 A * | 6/1981 | Shirai | B60T 13/52 | 181/230 |
| 4,673,043 A | 6/1987 | Greppmair | | |
| 4,809,402 A * | 3/1989 | Rainville | B29C 69/003 | 16/372 |
| 5,129,253 A * | 7/1992 | Austin | B23P 9/025 | 29/426.4 |
| 5,137,096 A | 8/1992 | Druesdow | | |
| 5,145,265 A * | 9/1992 | Flem | F16C 33/20 | 384/276 |
| 5,285,858 A * | 2/1994 | Okada | E02F 3/966 | 173/162.1 |
| 5,309,620 A * | 5/1994 | Shinohara | B29C 65/5057 | 29/432 |
| 5,645,400 A * | 7/1997 | Hunter | B64C 27/33 | 416/134 A |

(Continued)

FOREIGN PATENT DOCUMENTS

CN 201959831 9/2011

*Primary Examiner* — Scott A. Smith

(57) ABSTRACT

A powered hammer includes a housing having a proximal end and a distal end. The distal end includes an opening for a tool to pass through. The powered hammer further includes a shroud member coupled to the housing and configured to surround an outer surface of the distal end of the housing. The shroud member includes an opening on a lower surface thereof. The opening is configured to allow the tool to pass through. The shroud member is made from a ceramic material with a layer of fiber glass disposed adjacent to the outer surface of the distal end of the housing. The shroud member is configured to reduce heat transfer to the housing from an ambient environment proximate the distal end of the housing.

1 Claim, 5 Drawing Sheets

(56) References Cited

U.S. PATENT DOCUMENTS

| | | | | |
|---|---|---|---|---|
| 5,810,562 | A * | 9/1998 | Byrnes | B64C 27/605 416/114 |
| 5,954,157 | A * | 9/1999 | Grimes | E06C 1/12 16/329 |
| 6,095,257 | A * | 8/2000 | Lee | B25D 17/24 173/162.1 |
| 6,427,782 | B2 * | 8/2002 | Brady | C21D 9/22 173/DIG. 2 |
| 6,510,904 | B1 | 1/2003 | Tyrrell | |
| 7,047,596 | B2 * | 5/2006 | Sucic | B64C 27/32 16/2.1 |
| 7,628,222 | B2 * | 12/2009 | Yoshimura | E02F 3/966 173/162.1 |
| 8,061,439 | B2 * | 11/2011 | Nelson | B28D 1/26 173/128 |
| 8,342,264 | B1 * | 1/2013 | Hinshaw | E21B 41/00 173/DIG. 2 |
| 8,360,167 | B2 | 1/2013 | Jagdale et al. | |
| 8,500,207 | B2 | 8/2013 | Craven et al. | |
| 2009/0304315 | A1 * | 12/2009 | Johnson | B23P 9/025 384/295 |
| 2010/0139939 | A1 * | 6/2010 | Kim | B25D 17/00 173/115 |
| 2012/0145422 | A1 * | 6/2012 | Nickels | B25D 17/00 173/46 |
| 2012/0145424 | A1 * | 6/2012 | Nickels | E02F 3/966 173/90 |

* cited by examiner

SHROUD MEMBER FOR A POWERED HAMMER

TECHNICAL FIELD

The present disclosure relates to a powered hammer, and more particularly to a shroud member for a powered hammer.

BACKGROUND

Powered hammers generally include a tool extending partially out of a housing. Such hammers typically include a power cell that actuates the tool. The tool strikes against various work surfaces resulting in disintegration of material. The hammers may be used in foundry and other metallurgical operations where the hammer is exposed to high temperature conditions. For example, while used on high temperature slag or sand, various components of the hammer may be exposed to heat transmitted from the external environment. The heat may have an adverse effect on the components of the hammer.

U.S. Pat. No. 5,137,096 (the '096 patent) describes a flexible metal dust boot, comprising a bellows, and a surrounding protective shroud capable of withstanding high temperatures. The boot and shroud are mounted on a support plate, which can be conveniently attached to the body of a reciprocatable hydraulic or pneumatic hammer. The boot and shroud extend from the bottom of the hammer body, in surrounding relationship to the tool. The support plate forms a seal against the bottom surface of the hammer body. The bellows is attached to the plate at one end, and to the tool, in fluid tight relationship, at the other end. An air fitting in the bellows structure facilitates connection to a pressurized air source to inhibit the entry of particulate matter as well as fluid if the hammer is submerged in use. During hammer operation, the bellows reciprocates with the tool. The shroud surrounds the bellows and extends the axial length of the bellows to shield the bellows from particulate matter generated during operation of the hammer.

SUMMARY OF THE DISCLOSURE

In one aspect of the present disclosure, a powered hammer is provided. The powered hammer includes a housing having a proximal end and a distal end. The distal end includes an opening for a tool to pass through. The powered hammer further includes a shroud member coupled to the housing and configured to surround an outer surface of the distal end of the housing. The shroud member includes an opening on a lower surface thereof. The opening is configured to allow the tool to pass through. The shroud member is made from a ceramic material with a layer of fiber glass disposed adjacent to the outer surface of the distal end of the housing. The shroud member is configured to reduce heat transfer to the housing from an ambient environment proximate the distal end of the housing.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
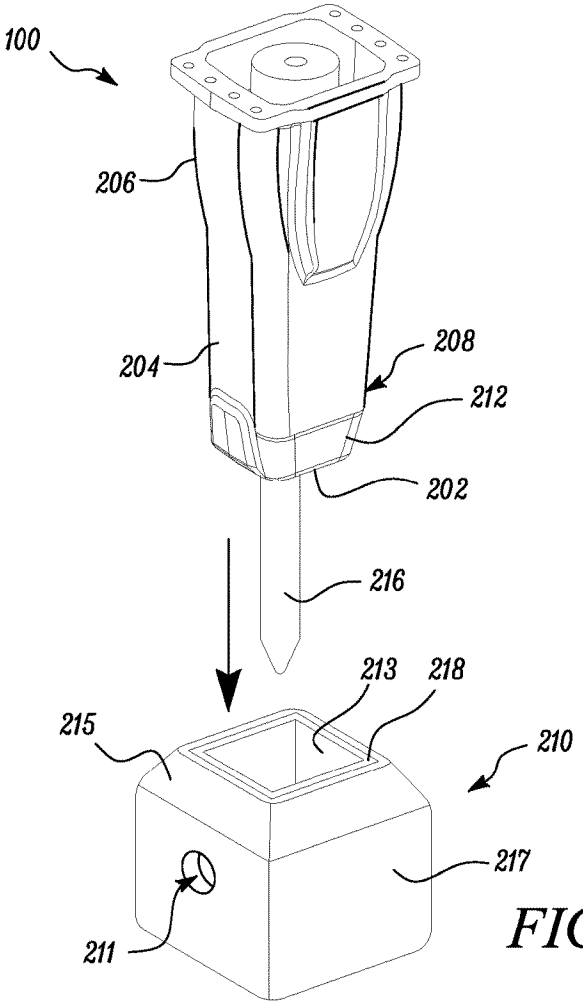
FIG. 1 is a perspective view of an exemplary powered hammer, according to an embodiment of the present disclosure.

FIG. 1 illustrates an exemplary powered hammer 100. The powered hammer 100 may perform various types of operation associated with an industry such as foundry, forging, metallurgy, mining, construction, agriculture, or any other industry known in the art. In an embodiment, the powered hammer 100 may be mounted on a machine (not shown) for powering and moving the powered hammer 100. The machine may be a backhoe, a skid steer an excavator, and the like. Alternatively, the powered hammer 100 may be manually handled during operation.

The powered hammer 100 includes a housing 204. The housing 204 may be formed as a single pipe or multiple portions that are joined together. The housing 204 includes a proximal end 206 and a distal end 208. In the illustrated embodiment, the housing 204 may taper from the proximal end 206 to the distal end 208. The distal end 208 defines a hammer opening 202 for a tool 216 to pass through. The distal end 208 further includes an outer surface 212.

Figure 2:
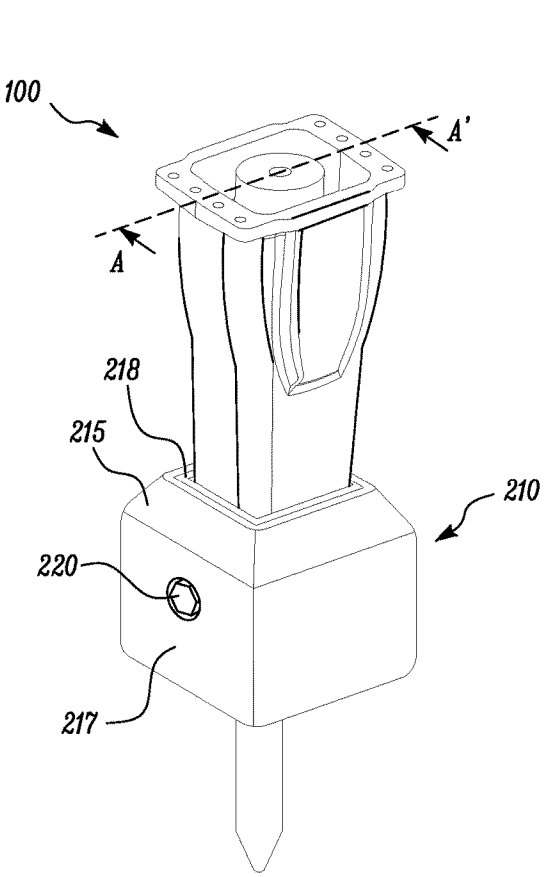
FIG. 2 is a perspective view of the powered hammer with a shroud member, according to an embodiment of the present disclosure.

FIG. 1 also illustrates a shroud member 210, according to an embodiment of the present disclosure. FIG. 2 illustrates a perspective view of the powered hammer 100 with the shroud member 210 coupled thereto. Referring to FIGS. 1 and 2, the shroud member 210 may be configured to be secured to the outer surface 212 of the distal end 208. The shroud member 210 defines a cavity 213 therein. The cavity 213 may be configured to receive the outer surface 212 of the distal end 208. The cavity 213 may have a cross-sectional shape substantially similar to the outer surface 212. In the illustrated embodiment, each of the housing 204 and the cavity 213 may have a substantially rectangular cross-section. The shroud member 210 further includes a layer 218 disposed adjacent to the outer surface 212 of the distal end 208. The shroud member 210 may be an integrally formed or made of multiple components affixed to one another and/or the housing 204. For example, the shroud member 210 may include two parts that are disposed around the outer surface 212 and secured to the housing 204. The shroud member 210 may be secured to the powered hammer 100 via fasteners 220 (shown in FIG. 4). The shroud member 210 may include apertures 211 for receiving the fasteners 220. The apertures 211 may be aligned with corresponding apertures (not shown) of the housing 204. The fasteners 220 may be bolts, screws, rivets, and the like. Alternatively, the shroud member 210 may be secured to the housing 204 by any method known in the art, such as welding, press-fitting, clamping, and the like.

Figure 3:
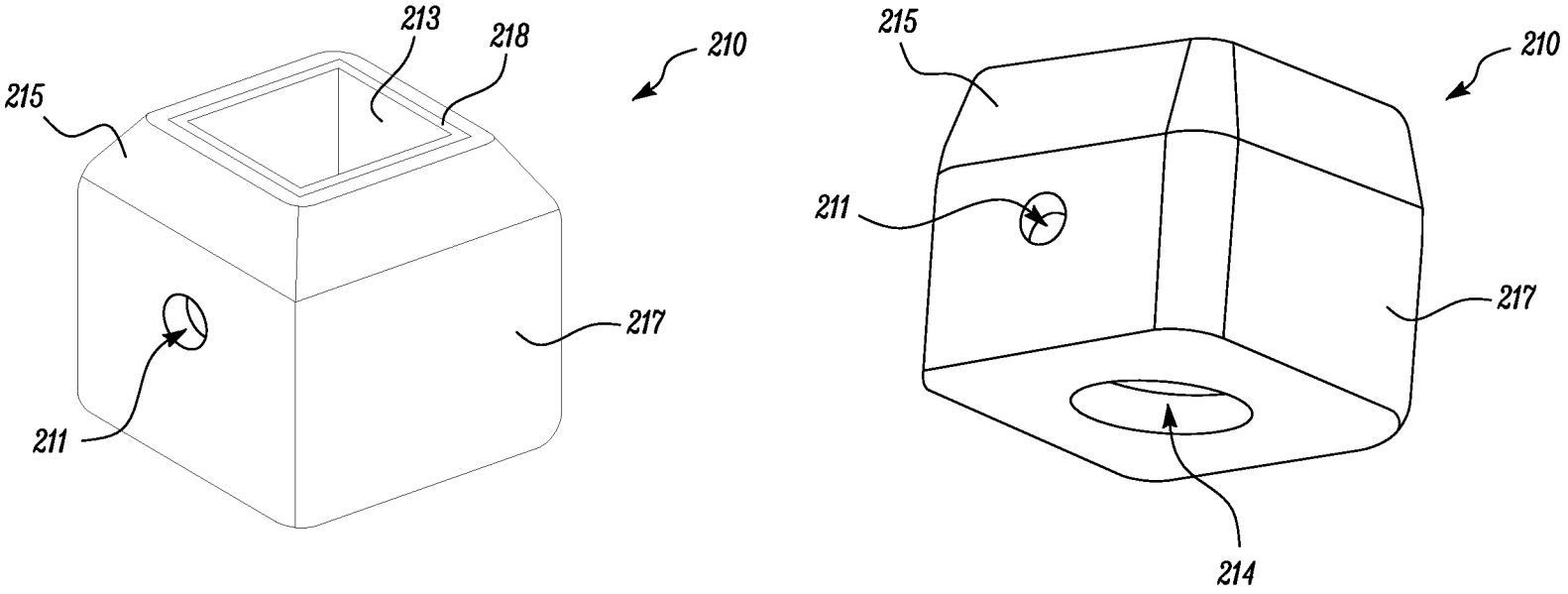
FIG. 3 illustrates perspective views of the shroud member, according to an embodiment of the present disclosure.

FIG. 3 illustrates perspective views of the shroud member 210. The shroud member 210 further defines a shroud opening 214 for the tool 216 to pass through. The shroud opening 214 may communicate with the cavity 213. In an embodiment, the shroud member 210 is secured to the outer surface 212 such that the hammer opening 202 and the shroud opening 214 are coaxially aligned, and the tool 216 may pass through both the hammer opening 202 and the shroud opening 214. In an embodiment, the shroud member 210 is made up of a heat resistant material. The heat resistant material may be ceramic. Further, the layer 218 may be made of fiber glass In various examples, the shroud member 210 may be manufactured by powder metallurgy, molding, and the like. The heat resistant material and the layer 218 of fiber glass may be configured to reduce heat transfer to the housing 204 from the ambient environment proximate the distal end 208 of the housing 204. Further, as shown in FIGS. 1 to 3, the shroud member 210 may include a first portion 215 and a second portion 217 adjacent to the first portion 215. The first portion 215 may have a tapered shape, while the second portion 217 may have a cuboidal shape.

Figure 4:
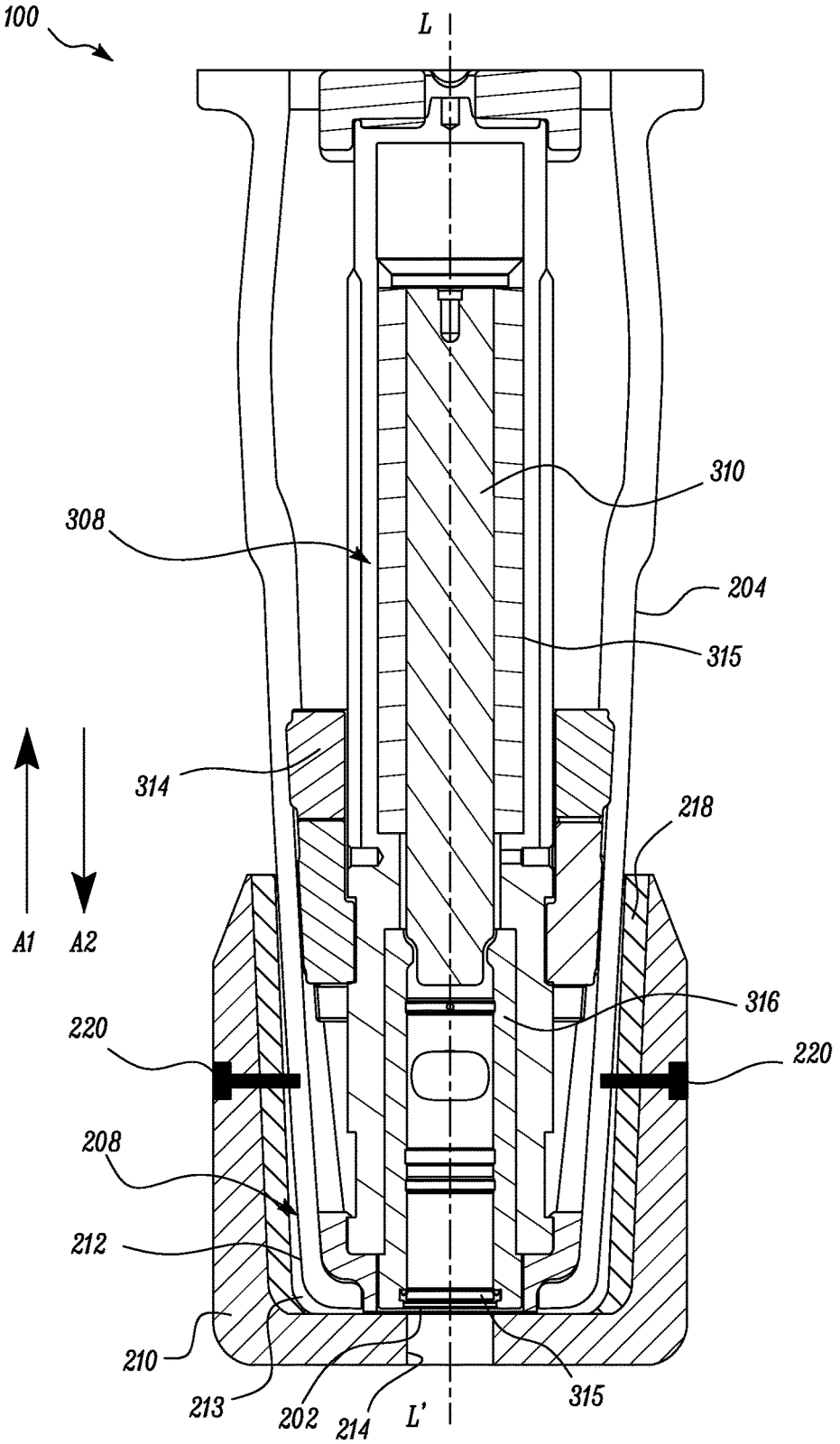
FIG. 4 is a sectional view of the powered hammer taken along line A-A' of FIG. 2, according to an embodiment of the present disclosure.

FIG. 4 shows a sectional view of the powered hammer 100 of FIG. 2, according to an embodiment of the present disclosure. The tool 216 is not shown for exemplary purposes.

A power cell 308 is disposed inside the housing 204. The power cell 308 includes several internal components of the powered hammer 100. As shown in FIG. 4, the power cell 308 provides an impact assembly that includes a piston 310. The piston 310 is operatively housed within the power cell 308 such that the piston 310 may reciprocate along a longitudinal axis L-L', as indicated by arrows A1 and A2. In particular, during a work stroke, the piston 310 moves in the general direction of arrow A2, while during a return stroke the piston 310 moves in the general direction of arrow A1.

The tool 216 (shown in FIGS. 1 and 2) may be drivably coupled to the power cell 308. The tool 216 may be operatively positioned within the power cell 308 to move along the longitudinal axis L-L'. Side buffers 314 are disposed between the housing 204 and the power cell 308. The side buffers 314 may be configured to absorb vibrations from the power cell 308 and minimize wear of the housing 204. Further, the power cell 308 may include seals 315 disposed around the piston 310 and the tool 216. One or more bushings 316 may also be positioned within the power cell 308 for facilitating movement of the tool 216.

As shown in FIG. 4, the fasteners 220 secure the shroud member 210 to the outer surface 212. The fasteners 220 may be received within the apertures 211 of the shroud member 210 and the corresponding apertures of the housing 204. Further, the cavity 213 may have a non-uniform width conforming to the taper of the housing 204. In an example, a clearance (not shown) may be provided between the cavity 213 and the outer surface 212. It may be apparent to a person ordinarily skilled in the art that the shroud member 210, as illustrated in FIGS. 1 to 4, is exemplary in nature, and a shape and/or dimensions of the shroud member 210 may vary as per the configuration of the distal end 208 of the housing 204. Further, a width of the shroud opening 214 may be less than the width of the cavity 213. The width of the shroud opening 214 may be of sufficient value such that the tool 216 may pass there through.

A hydraulic system (not shown) may provide pressurized fluid to drive the piston 310 towards the tool 216 during a work stroke and to return the piston 310 during the return stroke. The hydraulic system is not described further, since it will be apparent to one skilled in the art that any suitable hydraulic system may be used to provide pressurized fluid to the piston 310. The piston 310 may be driven by any alternative means, for example, pneumatically or electrically, within the scope of the present disclosure.

During operation, near the end of the work stroke, the piston 310 may strike the tool 216. The tool 216 may impact against a working surface (not shown). In an example, the powered hammer 100 may be used in foundry applications. The working surface may be high temperature slag formed during a manufacturing process. The working surface may also be high temperature sand. The impact of the tool 216 may disintegrate the slag and/or the sand.

Figure 5:
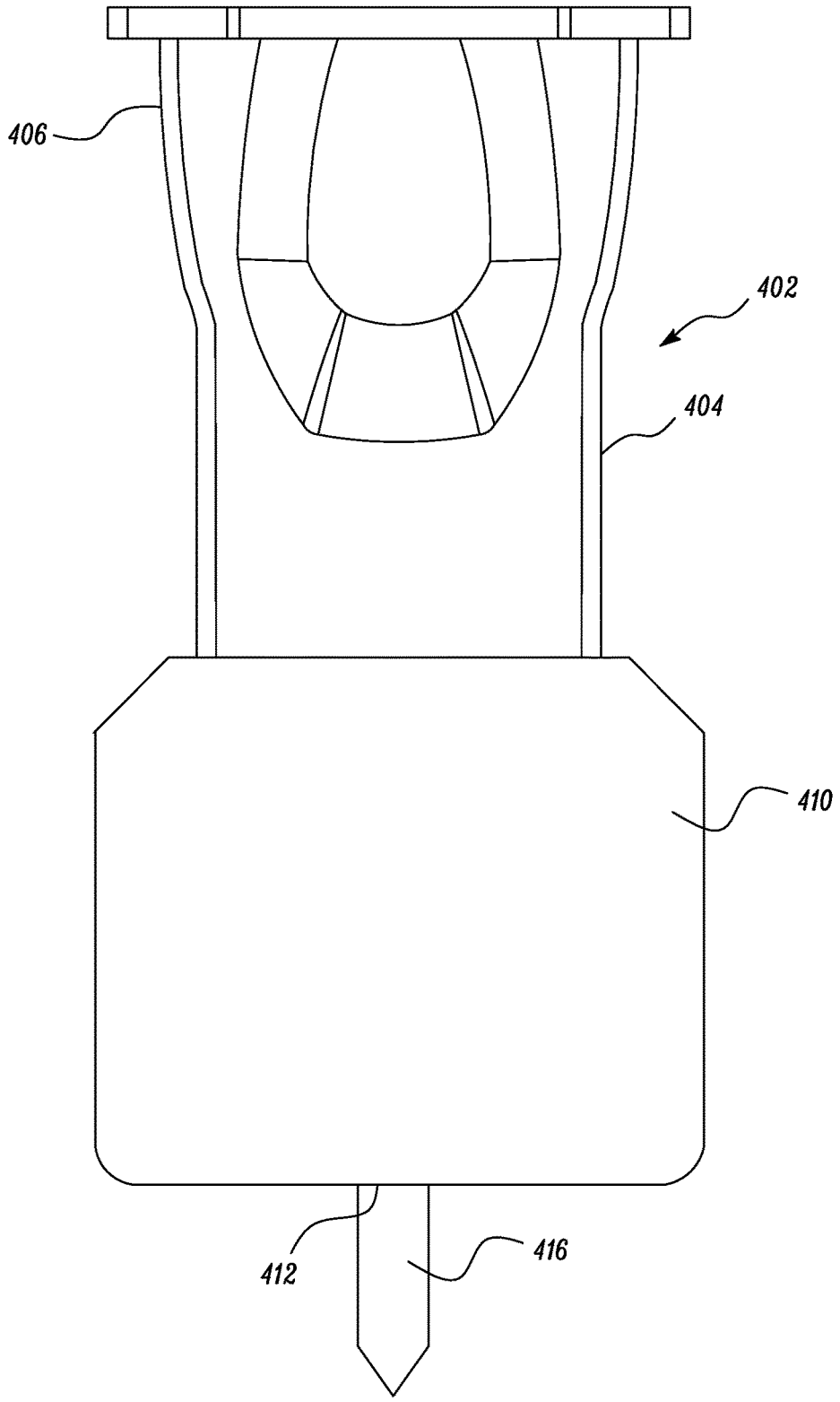
FIG. 5 is a side view of the powered hammer with the shroud member, according to another embodiment of the present disclosure.

FIG. 5 illustrates a powered hammer 402 with a shroud member 410, according to another embodiment of the present disclosure. The powered hammer 402 includes a housing 404. The housing 404 includes a proximal end 406 and a distal end 408 (shown in FIG. 6). The distal end 408 has a substantially cuboidal shape. The distal end 408 defines a hammer opening 412 for a to pass through. The distal end 408 further includes an outer surface 414. The shroud member 410 is configured to be secured to the outer surface 414 of the distal end 408. The shroud member 410 further defines a shroud opening 415 for the tool 416 to pass through. In an embodiment, the shroud member 410 is secured to the outer surface 414 such that the hammer opening 412 and the shroud opening 415 are coaxially aligned, and the may pass through both the hammer opening 412 and the shroud opening 415. The shroud member 410 includes a cavity 413 (shown in FIG. 6) configured to receive the outer surface 414 of the distal end 408. The shroud member 410 further includes a layer 417 disposed adjacent to the outer surface 414 of the distal end 408. The shroud member 410 may be secured to the powered hammer 402 via fasteners 420 (shown in FIG. 6). A shape of the cavity 413 may substantially conform to the shape of the outer surface 414. Further, the cavity 413 may have a substantially uniform width along a length thereof.

Figure 6:
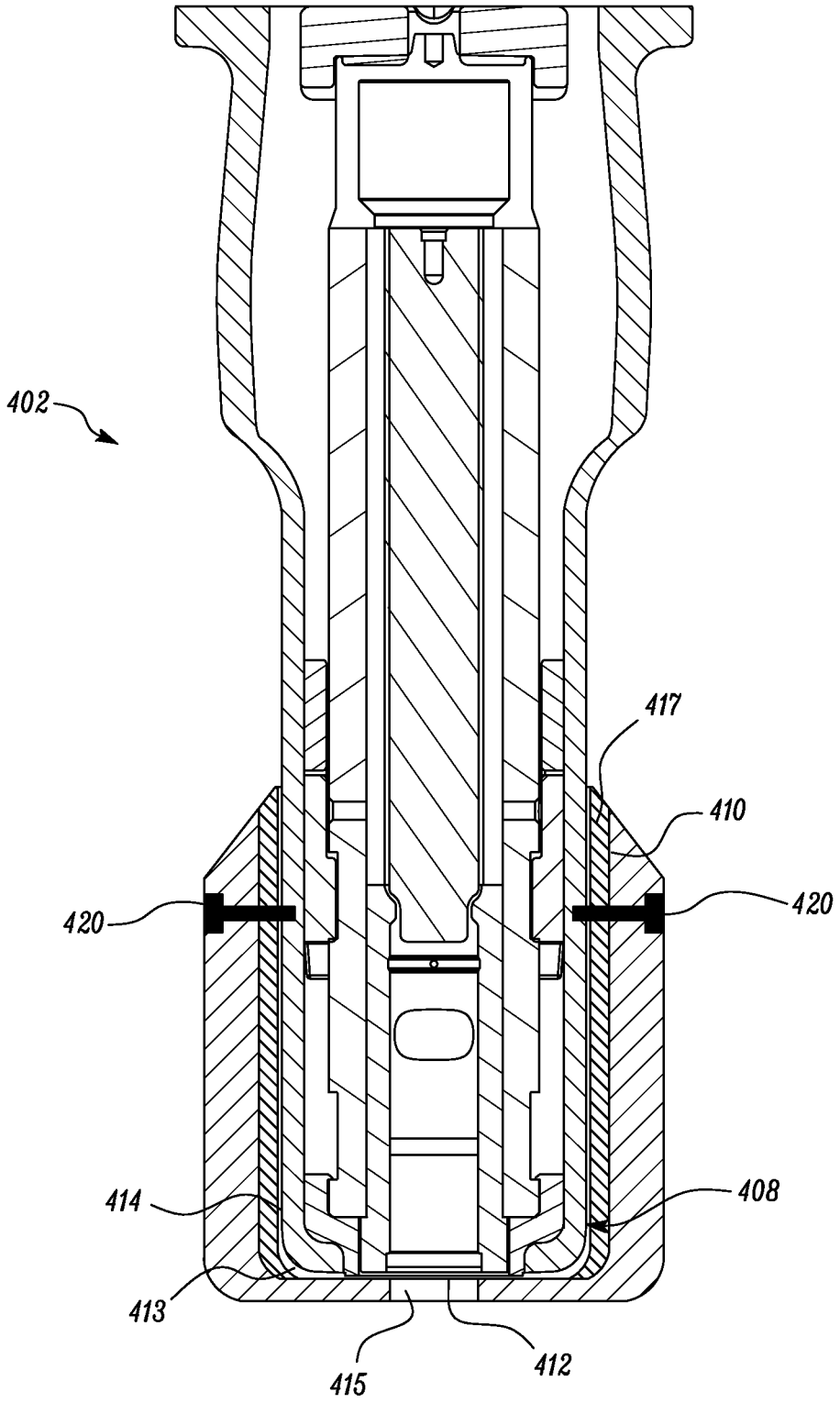
FIG. 6 is a sectional view of the powered hammer of FIG. 5, according to another embodiment of the present disclosure.

FIG. 6 shows a sectional view of the powered hammer 402 of FIG. 5. The internal components of the powered hammer 402 may be equivalent to the internal components of the powered hammer 100. As mentioned earlier, the shroud member 410 may be made of a heat resisting material similar to the shroud member 210.

INDUSTRIAL APPLICABILITY

The present disclosure is related to the powered hammers 100, 402. The powered hammers 100, 402 may be used in various industries, such as foundry, forging, metallurgy, mining, construction, agriculture, or any other industry known in the art. In an example, the powered hammers 100, 402 may be used in foundry applications. The working surface may be high temperature slag formed during a manufacturing process. The working surface may also be high temperature sand. The impact of the tool 216 may disintegrate the slag and/or the sand.

During such operations, heat may be transmitted from the ambient environment to the powered hammers 100, 402. Further, due to disintegration of material, high temperature particles may also impinge against the powered hammer 100, 402. The powered hammer 100, 402 may be exposed to the ambient environment having high temperatures, for example, greater than 1000 degree Celsius. However, various the internal components of the powered hammer 100,

402 may be heat sensitive and are designed to work under lower temperatures, for example, 100 to 150 degree Celsius. Such internal components may include the side buffers 314, the seals 315 etc.

The shroud members 210, 410 may minimize heat transfer from the ambient environment proximate to the distal ends 208, 408. Therefore, the internal components of the powered hammers 100, 402 may be protected from high temperature environments. The shroud members 210, 410 may also be conveniently secured to existing powered hammers without requiring any substantial design changes. Further, a single shroud member may be reusable with multiple powered hammers having similar configuration. The shroud members may also be easily manufactured from heat resistant material, such as ceramic and fiber glass. A design and/or material of the shroud members may be modified as per configurations and/or applications of the powered hammers.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A powered hammer comprising:

a housing having a proximal end and a distal end, the distal end including an opening for a tool to pass through; and a shroud member coupled to the housing and configured to surround an outer surface of the distal end of the housing, the shroud member including an opening on a lower surface thereof, the opening configured to allow the tool to pass through, wherein the shroud member is made from a ceramic material with a layer of fiber glass disposed adjacent to the outer surface of the distal end of the housing, the shroud member configured to reduce heat transfer to the housing from an ambient environment proximate the distal end of the housing.

* * * * *